United States Patent [19]

Corbiere

[11] 3,955,379

[45] May 11, 1976

[54] HIGH SPEED KNITTING MACHINE

[76] Inventor: Claude Corbiere, 25 rue St. Andre-Riorges, 42300 Roanne, France

[22] Filed: Oct. 10, 1973

[21] Appl. No.: 405,088

[30] Foreign Application Priority Data

Oct. 10, 1972 France ..... 72.36490

[52] U.S. Cl. ..... 66/1 R; 66/132 R; 57/157 TS

[51] Int. Cl.[2] ..... D04B 35/00

[58] Field of Search ..... 66/132 R, 125 R, 1 R, 66/8, 57, 9 R, 9 A, 55; 57/157 TS

[56] References Cited

UNITED STATES PATENTS

| | | | |
|---|---|---|---|
| 180,250 | 7/1876 | Marshall | 66/57 |
| 569,463 | 10/1896 | Minich | 66/8 |
| 1,795,683 | 3/1931 | Schoenfeld | 66/125 R |
| 2,239,212 | 4/1941 | Adams | 66/1 R |
| 3,134,248 | 5/1964 | Kubelka et al. | 66/125 R |
| 3,333,441 | 8/1967 | Soussloff et al. | 66/147 |
| 3,421,344 | 1/1969 | Moyer et al. | 66/55 |
| 3,511,064 | 5/1960 | Major et al. | 66/125 R |
| 3,611,701 | 10/1971 | Scherzberg | 66/125 UX |
| 3,768,278 | 10/1973 | Latella | 66/9 A |
| 3,774,412 | 11/1973 | Schichman | 66/9 R |
| 3,890,809 | 6/1975 | Tenconi | 66/132 R |

OTHER PUBLICATIONS

Strasser, F. *Some Conventional and Unconventional Methods and Processes in Double Jersey Production of the Future*, in Textile Institute and Industry, 8(12): pp. 337–340. Dec. 1970.

MacDonald, James, Jr. *Elementary Circular Knitting*, a French Textile School, Georgia Institute of Technology, 1952.

Reichman, C. (edited by, *Principles of Knitting Outerwear Fabrics and Garments*, N.Y. National Knitted Outerwear Assoc. 1962, pp. 22–24.

*Primary Examiner*—W. C. Reynolds
*Assistant Examiner*—A. M. Falik
*Attorney, Agent, or Firm*—Sherman & Shalloway

[57] ABSTRACT

Methods of and apparatus for manufacturing a knitted fabric from a strand of yarn by forming the yarn into series of interlaced loops. The apparatus includes an array of apertures through which sinusoidal loops of the strand are ejected sequentially, by a combination of an expanding stream of fluid and centrifugal force. As each loop is ejected through an aperture in the array, the loop is restrained on one side of the aperture by a reciprocation shoe and then lifted upwardly by the shoe while being held open by the shoe. A subsequent loop is then ejected through the first loop, and the shoe is moved downwardly to restrain the subsequent loop and to release the first loop. As the shoe moves downwardly, the first loop is pulled through the aperture by a reciprocating hook which engages the foot of the first loop on the other side of the aperture. The subsequent loop is then lifted as the shoe passes through the loop in preparation to receive another loop, so that the process of interlacing loops is continued.

21 Claims, 12 Drawing Figures

HIGH SPEED KNITTING MACHINE

BACKGROUND OF THE INVENTION

1. Field of the Invention

The present invention relates to methods of and apparatus for manufacturing knitted articles. More particularly, the present invention relates to a methods of and apparatus for manufacturing knitted articles with looped-shaped stitches.

2. Technical Considerations and Prior Art

Weft knitting of textile fabrics with looped-shaped stitches has been practiced for many years. The prior art technique of weft knitting with looped-shaped stitches generally includes forming yarn into rows of loops by engaging and lifting the yarn with an array of needles. As the yarn is formed into loops, subsequent loops are inserted into pre-existing loops to hold the pre-existing loops in place and thereby form a stitch. As subsequent stitches are formed, a knitted fabric is generated.

In order to manufacture the fabric at high speed, it is necessary for the needles which engage the yarn to effect a very fast vertical movement away from the plane of the fabric being manufactured. This is because it is necessary for each needle to complete a stitch before a subsequent or following needle begins a subsequent stitch. In reality, while one stitch is being formed, the needle making the subsequent stitch begins its operation before the first stitch is complete. However, the number of needles which can be arrayed in an overlapping relationship remains quite limited. This, of course, limits the speed at which textile fabric may be manufactured.

With respect to the instant invention, a primary concern is basically with the speed of the yarn, as it is fed into the knitting machine rather than the speed of manufacturing the fabric per se.

Since each stitch is formed in sequence, and each stitch requires a definite amount of time, upper speeds of the manufacturing operation are limited to yarn feed speeds of not much more than 500 m/min. This is largely due to stresses exerted on the yarn, as well as stresses exerted on moving mechanical parts, such as the needles, needle hooks, latches, cams, etc.

In order to attain speeds approximately 500 m/min., knitting machines of increasing sophistication must be resorted to. This high degree of sophistication, of course, creates an economic limitation on the type of equipment which may be used.

In addition, it is necessary with the prior art approaches to stop the knitting machinery in order to permit the threading up of the yarn. In many instances, stopping the machine results in great inconvenience since other associated machines in the manufacturing line must also be either stopped, idled or have their product side-tracked.

SUMMARY OF THE INVENTION

In view of the afore-mentioned problems, it is an object of the instant invention to provide new and improved methods of and apparatus for manufacturing knitted fabrics.

It is another object of the instant invention to provide new and improved methods of and apparatus for manufacturing knitted fabrics with a jersey stitch.

It is still another object of the instant invention to provide methods of and apparatus for manufacturing knitted articles at high yarn feed speeds, in particular, yarn feed speeds in excess of 500 m/min.

It is still a further object of the instant invention to provide a new and improved method of and apparatus for manufacturing knitted fabrics, wherein the method or apparatus need not be stopped for a threading-up operation.

It is an additional object of the instant invention to provide a new and improved apparatus for manufacturing knitted fabrics, wherein the method and apparatus may effect a threading-up operation while shut down, while operating at an average speed, or even while operating at high speed.

In accordance with these and other objects, a method of practicing the instant invention includes a first cycle in which yarn is inserted into an array of apertures to make a row of substantially sinusoidal loops which are temporarily held in position. A subsequent cycle follows, in which the yarn is again inserted into the same array of apertures to form a row of sinusoidal loops which are positioned in a plane different from the plane assumed by the loops of the first row. As soon as the first loop of the second row is formed, stitches are created by inserting sequentially the loops of the second row into the loops of the first row. An entire row of stitches is thereby formed during the second cycle. The operation is continued to manufacture the fabric by forming subsequent rows of loops which are inserted into preceding or prior rows of loops in the same manner that the second row of loops was inserted into the first row of loops.

In accordance with the afore-mentioned objects and other objects, the apparatus for practicing the afore-mentioned method of manufacturing knitted fabrics includes a plurality of apertures arrayed in series and means for inserting loops of a strand of yarn through the apertures. In order to form stitches which comprise the knitted fabric, reciprocating shoes are positioned on one side of the apertures and reciprocating hooks are positioned on the other side of the apertures. After each loop is formed, a shoe retains the loop in the aperture and then frees the loop for the formation of the stitch by sliding down over and past the loop. The shoe then slides vertically into the eye of the loop to lift the loop up while holding it open. As the shoe slides upwardly, the hook slides downwardly to engage the foot of the loop and pull the loop through the aperture after the shoe again slides downwardly past the aperture and releases the loop. Upon inserting another series of loops into the apertures, the shoes and hooks cooperate to form another stitch and, thus, generate knitted fabric.

It is to be understood that the methods of and apparatus for practicing the present invention are not limited to circular knitting, but may also be applied to rectilinear knitting.

In practicing the step of inserting yarn into the afore-mentioned apertures, any known means may be used. For example, mechanical devices such as pushers may be used. However, in order to achieve high speed operation, it is preferable to use either centrifugal force, fluid expansion or a combination of both to insert the yarn.

The term "a plurality of apertures arrayed in series" is meant to define any set of obstacles so arranged as to enable the yarn to form a loop when inserted while moving laterally between two consecutive obstacles. For examples, it is well known in weaving and knitting processes and machines to use a comb or comblike device to provide these obstacles.

In an advantageous enbodiment of this invention, the yarn is introduced into a spinning, generally conical rotor turning inside of a fixed circular comb, wherein the comb has the same rotational axis and an approximately equal radius. At its center, the rotor may have a venturi which serves to entrain a strand of yarn in a stream of air to carry the yarn into an axial bore formed in the rotor. Registering with the axial bore is a radial bore which directs the entrained strand of yarn to the fixed circular comb having the afore-mentioned array of apertures therein. In practice, the radial bore of the rotor may be slanted at an angle of perhaps 45° with the axial bore of the rotor.

With the afore-described arrangement, the formation of loops is independent of the formation of stitches with the loops being formed successively without any mechanical intervention, other than the continuous rotation of the rotor. In other words, the stitches are not formed "needle after needle", but progressively during the duration of a series of successive cycles. Consequently, for the same feed speed of knitted yarn, the parts of the knitting machine of the present invention move slower and with a more even cadence than the parts of prior art knitting machines, resulting in a smoother knitting operation. This smoother operation allows the knitting machine of the instant invention to reach much higher speeds than were previously attainable.

On conventional weft knitting machines, the yarn is pulled by a needle through a previous loop to form a stitch and the same yarn is pulled again by the next needle through the next loop to form the next stitch. According to the method of the present invention, the yarn is pushed to form the loops in a row. For that very precise reason, the method of this invention can be called "self-shaping of the loops". Afterward, the loops of a row are slowly and progressively positioned, entangled or interlaced in the previously existing loops of the previous row to form the corresponding stitches.

BRIEF DESCRIPTION OF THE DRAWINGS

In the ensuing detailed description, reference is made to the accompanying drawings, in which.

DETAILED DESCRIPTION

Figure 1:
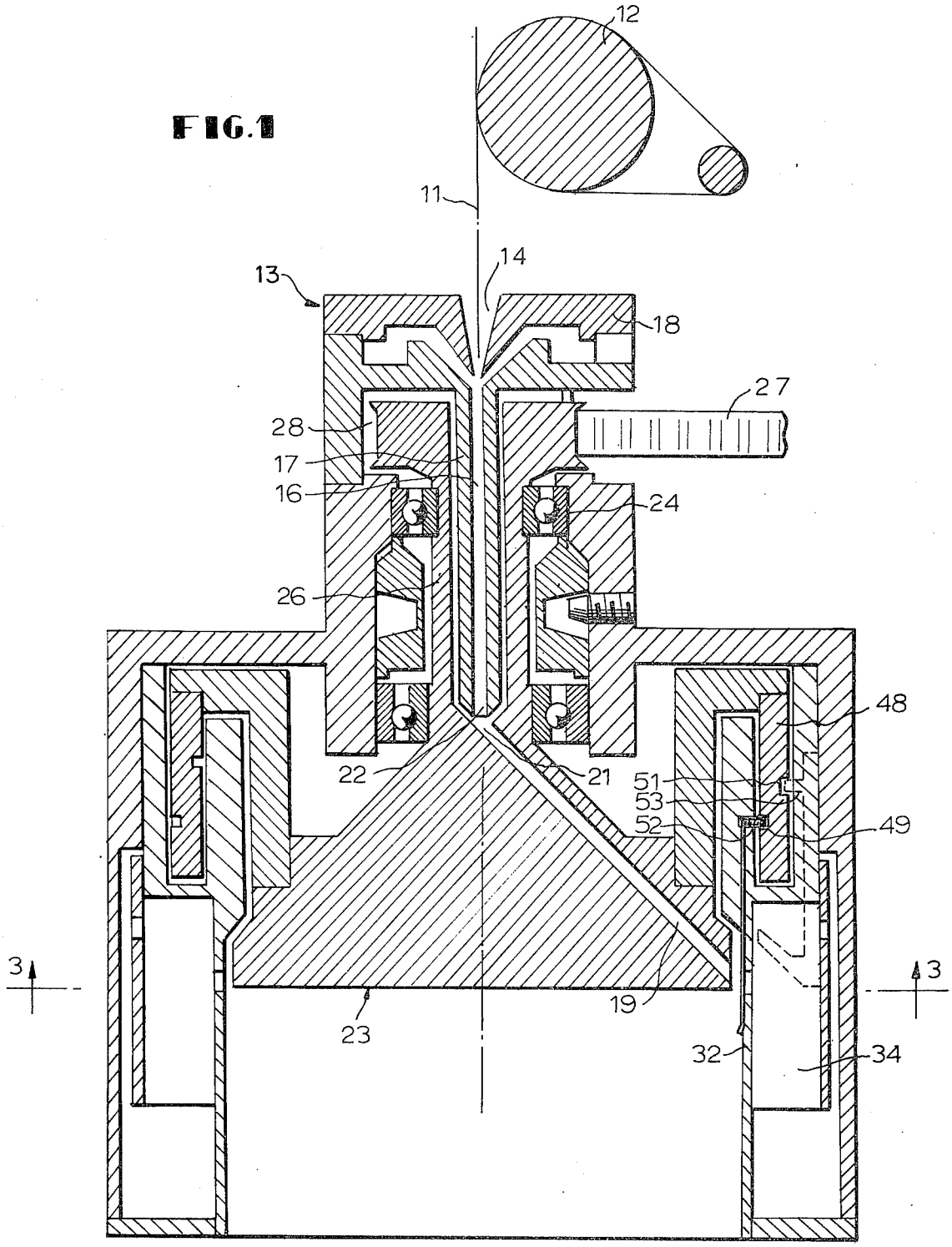
FIG. 1 is a diagrammatic view of an apparatus in accordance with the instant invention shown in longitudinal section and illustrating a circular knitting machine which receives a strand of yarn fed from a feeding device to generate a knit sock.

Referring now to FIG. 1, there is shown a strand of yarn 11 which is advanced from a feedig device 12 which, if desired, may be a spinnerette, to a knitting apparatus, designated generally by the numeral 13, which is used to practice the method of the instant invention. The knitting apparatus 13 is a preferred embodiment of this invention. The yarn 11 initially enters the knitting apparatus 13 through an opening 14 in the top of the knitting apparatus. The opening 14 is aligned with the bore 16 of a tube 17 which extends down into the knitting apparatus 13. In order to move the strand of yarn 11 through the bore 16, the strand is entrained in a stream of fluid, such as a stream of air, which enters the bore from an ejector nozzle 18 that surrounds the opening 14. After the yarn 11 passes through the bore 16, it is directed laterally of its initial path into a radial discharge tube 19 that is aligned at its inlet end 21 with the discharge end 22 of the bore 16. In the illustrated embodiment, the radial discharge tube 19 is formed in a conical head or spinner, designated generally by the numeral 23, which is supported in the knitting machine 13 by ball bearings 24 that retain a cylindrical neck portion 26 of the spinner in alignment with the tube 17. In the illustrated embodiment, the tube 17 and the neck portion 26 are axially aligned and the conical spinner 23 is rotated by a drive belt 27 which is entrained around a pulley 28 secured rigidly to the neck portion.

Figure 3:
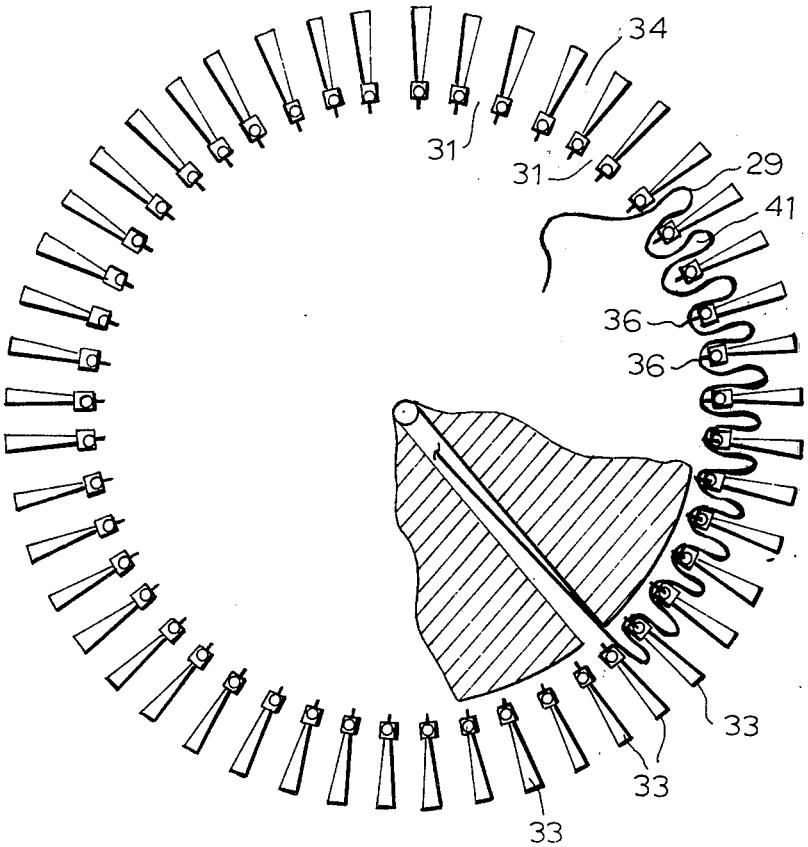
FIG. 3 is a sectional view taken along lines 3—3 of FIG. 1 and showing how a sinusoidal series of yarn loops is ejected through an array of apertures by a rotor.

As the conical spinner 23 rotates, it dispenses the yarn 11 radially along its periphery, as perhaps best seen in FIG. 3. This ejection is accomplished by a combination of the escaping air stream which expands out of the radial discharge tube 19 and centrifugal force imparted to the strand 11 due to rotation of the conical spinner 23. However, either the escaping air expanding out of the discharge tube alone or centrifugal force alone may be used to effect ejection. As seen in FIG. 3, the yarn 11 forms into loops, designated generally by the numeral 29, as it is ejected from the tube 19. This is because the tube 19 registers sequentially with apertures 31 as the conical spinner 23 rotates, forcing the yarn through the apertures as the stream of fluid expands through the apertures and the centrifugal force acts on the yarn. Since the yarn is continuous, it forms the loops 29 into what could be described as a substantially sinusoidal configuration. After the conical spinner 23 completes one revolution, forming a first circle of loops, a second revolution of the conical spinner forms a second circle of loops, and so forth.

The apertures 31 are formed in a magazine which is in the form of a circular comb 32 positioned around and extending just below the conical spinner 23. The apertures 31 are defined by the teeth of the circular comb 32, which form a series of elements which are stationary with respect to one another in the direction of loop protrusion. The circular comb 32 has a series of partitions 33 which extend radially therefrom to form compartments 34 adjacent each aperture 31. The apertures 31 and partitions 33 are stations at which stitches are formed. These partitions retain the loops 29 within the compartments 34 and prevent the loops projecting through one aperture 31 from becoming entangled with the loops of an adjacent aperture. After a single row of loops 29 is ejected through the apertures 31, it is necessary to eject a subsequent row of loops 29′ through both the apertures 31 in the comb 32 and the eyes 41 of the loops 29 forming the initial row. This is accomplished by engaging the loops 29 with hooks 42 and shoes 43 which engage the feet 36 or the bottom portion of the loops 29, and ends 37 or the bottom portion of the loops 29, respectively. The hooks 42 are secured rigidly to reciprocating shafts 46 which slide within slots 44 formed in the inner wall of the comb 32. The slots 44 are generally positioned opposite the partitions 33. The shoes 43 are pivoted to reciprocating shafts 47 that are disposed to reciprocate within one of the compartments 34. The shoes reciprocated by the shafts 47 form first elements for manipulating the loops, while the hooks 42 reciprocated by shafts 46 form second elements for drawing previously formed loops about subsequently formed loops to set the progressively formed stitches.

In order to properly form a stitch, the movement of the hooks 42 and shoes 43 must be coordinated. This is accomplished by a circular cam 48 which is rigidly secured to the conical spinner 23 to rotate therewith. Keep in mind that the rotating parts are pulley 28, neck 26, spinner 23, and cam 48, along with the structure connecting the cam 48 to the spinner 23. The other parts of the machine are either static or they reciprocate. The circular cam 48 has inner and outer tracks 49 and 51, respectively, into which followers 52 and 53 extend from the reciprocating shafts 46 and 47, respectively. The cam tracks 49 and 51 are generally sinusoidal in configuration, but are out of phase so that, as the shaft 46 is rising, the shaft 47 may be lowering or vice versa, so as to move the hooks 42 and shoes 43 relative to one another.

Although the cam tracks 49 and 51 are out of phase, they are not 180° out of phase, as will be seen hereinafter. By programming the cam tracks 49 and 51 sinusoidally or rather manufacturing the cam tracks so as to be configured with a sinusoidal profile or configuration, a smooth, progressive operation of the hooks 42 and shoes 43 is accomplished.

Figure 4:
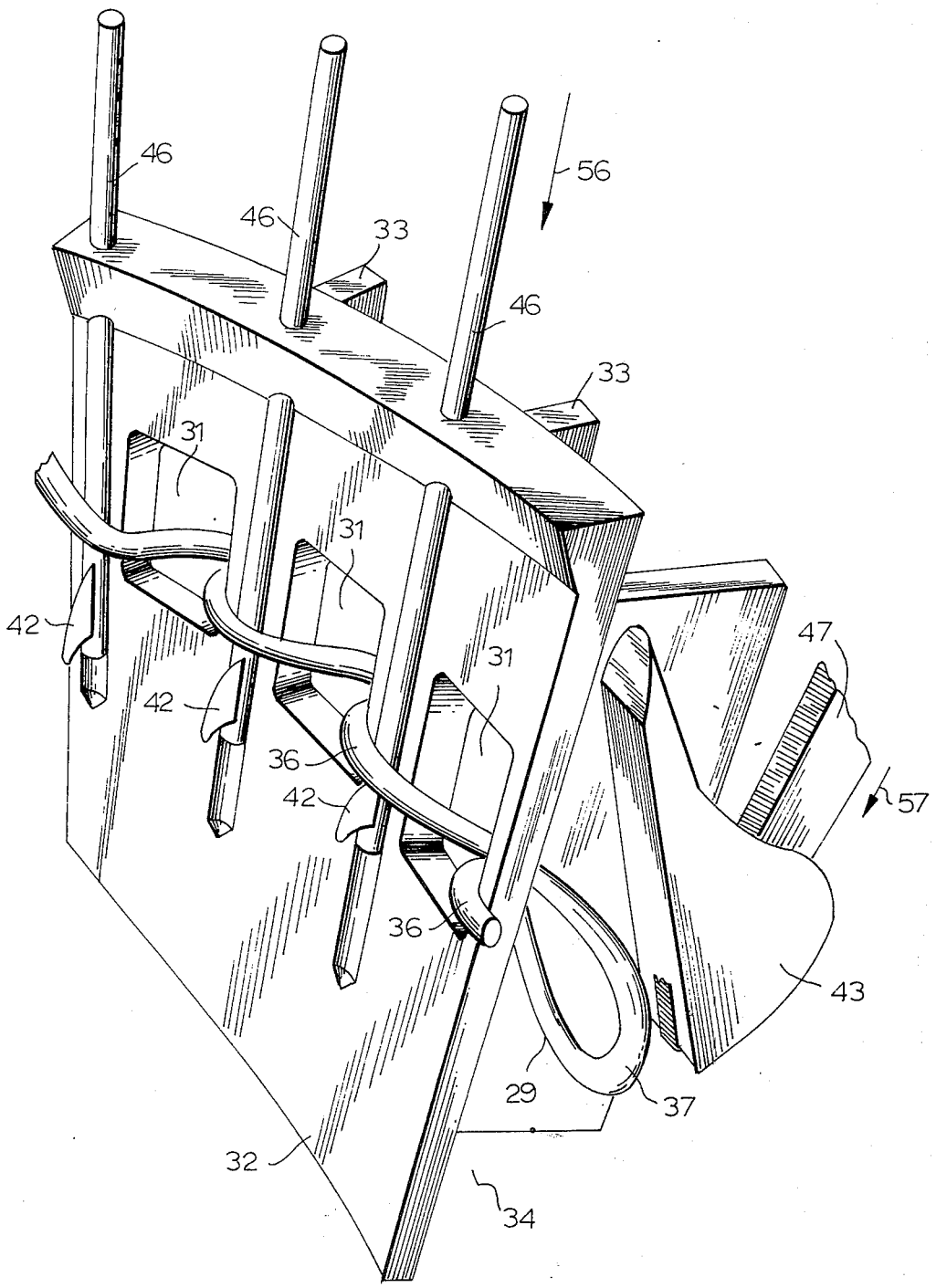
FIGS. 4 through 10 illustrate the various stages which occur during the formation of a single stitch by the apparatus shown in FIG. 1.

FIGS. 4 through 10 illustrate the steps involved in the formation of a single stitch. As shown in FIG. 4, the radial discharge tube 19 (FIG. 1) has ejected a loop 29 of yarn 11 through the aperture 31. The loop 29 is shown in FIG. 4 as passing behind, or rather just upstream, of the reciprocating shaft 46 which is shown travelling down in the direction of the arrow 56. The shoe 43 is in its highest position and is starting to descend in the direction of the arrow 57.

Figure 5:
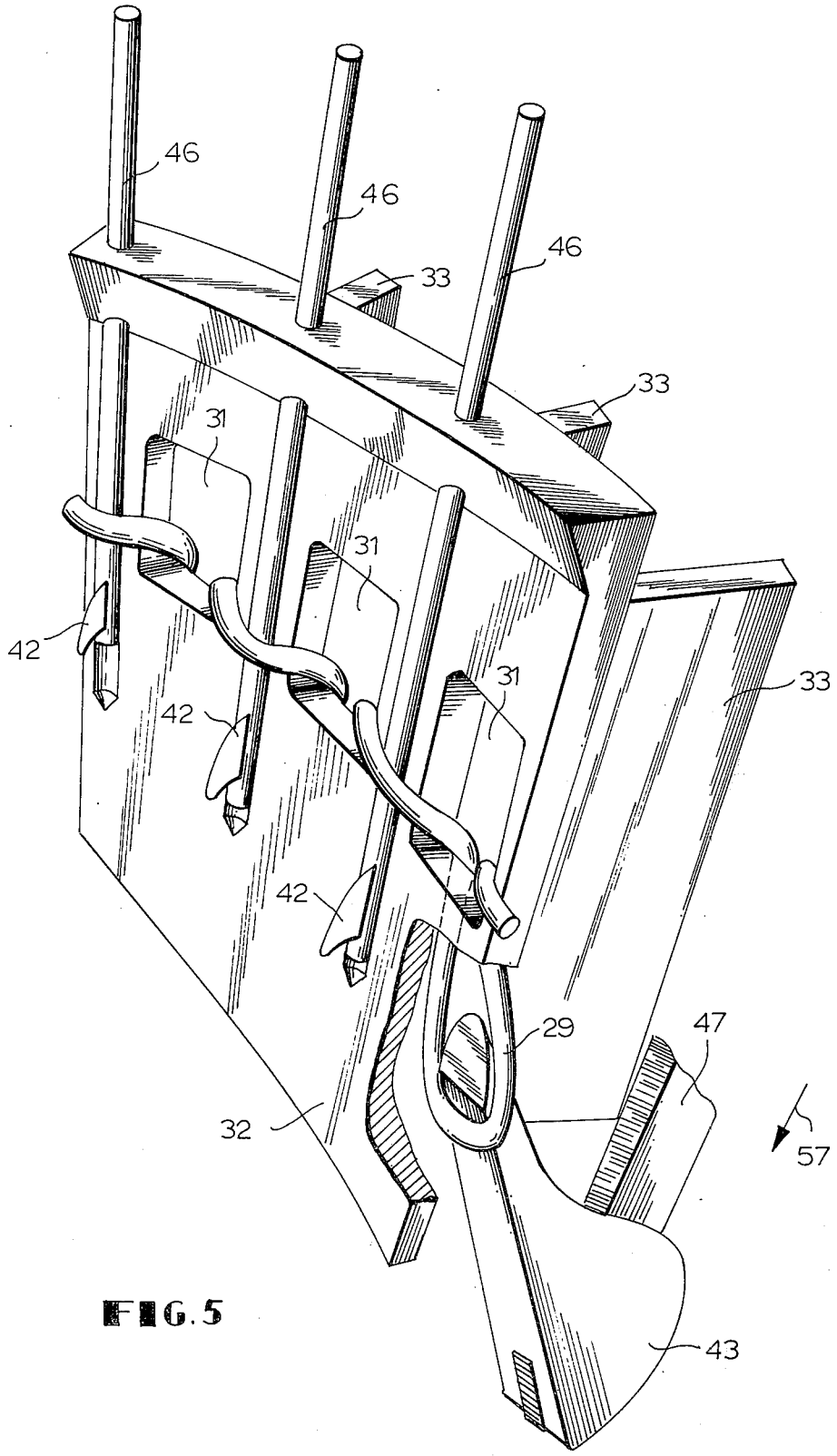

Referring now to FIG. 5, it is seen that the shoe 43 has moved to a position just below the aperture 31 and is holding the loop 29 against the comb 32. This is to prevent the loop 29 from somehow being dragged back out of the aperture 31 as the conical spinner 23 rotates. In FIG. 5, the shaft 46 and the attached hook 42 are shown at their lowermost postion from which they will start to rise in the direction of arrow 58, as shown in FIG. 6.

Figure 6:
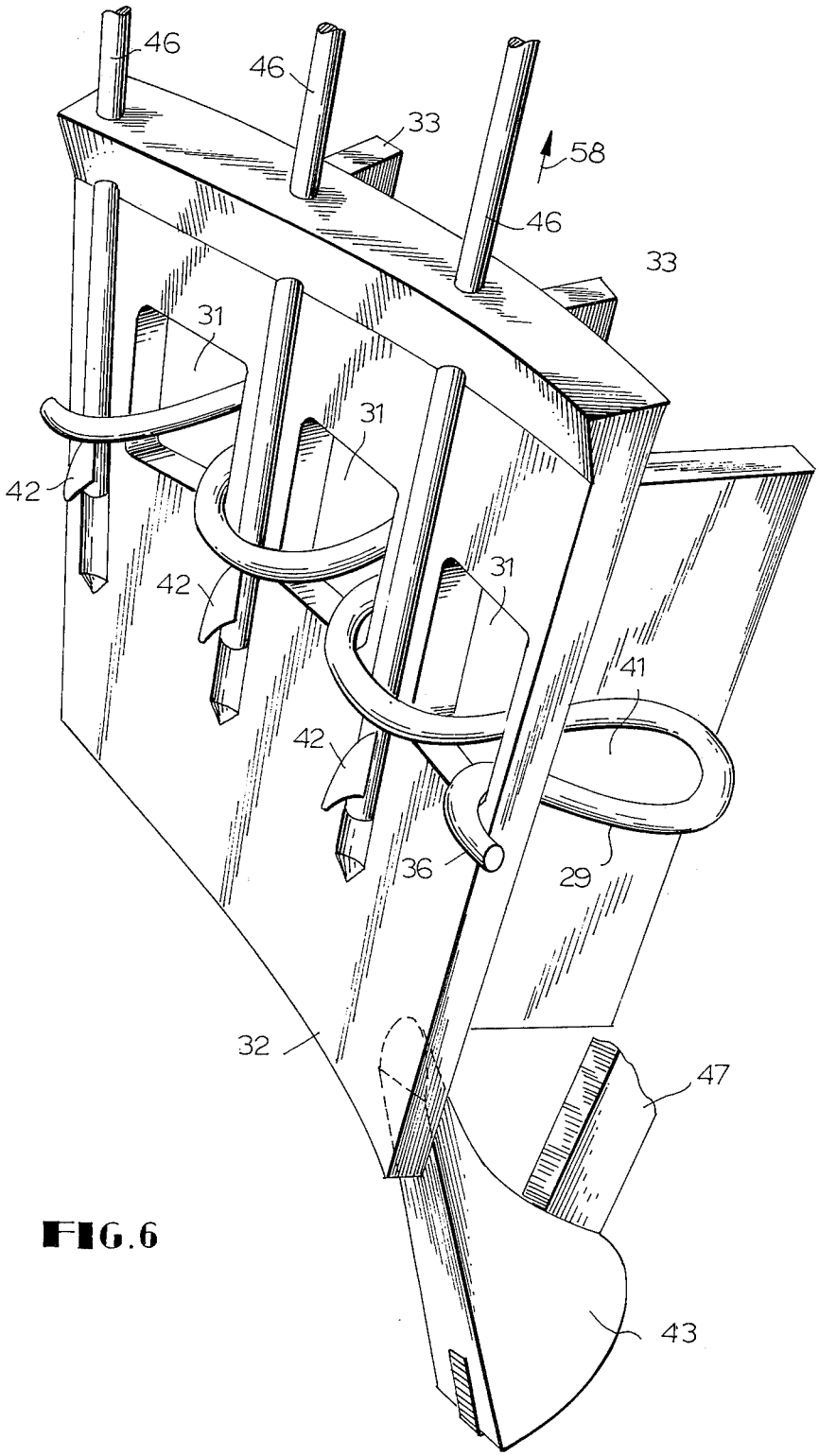

As shown in FIG. 6, the shoe 43 has moved to its lowermost position and has released the loop 29 from engagement with the comb 32 by moving below the loop. The loop 29, because of its elastic propensities, has sprung upwardly and spread so that the eye 41 is in position to receive the shoe 43 as the shoe 43 moves upwardly in the direction of the arrow 59 in FIG. 7.

Figure 2:
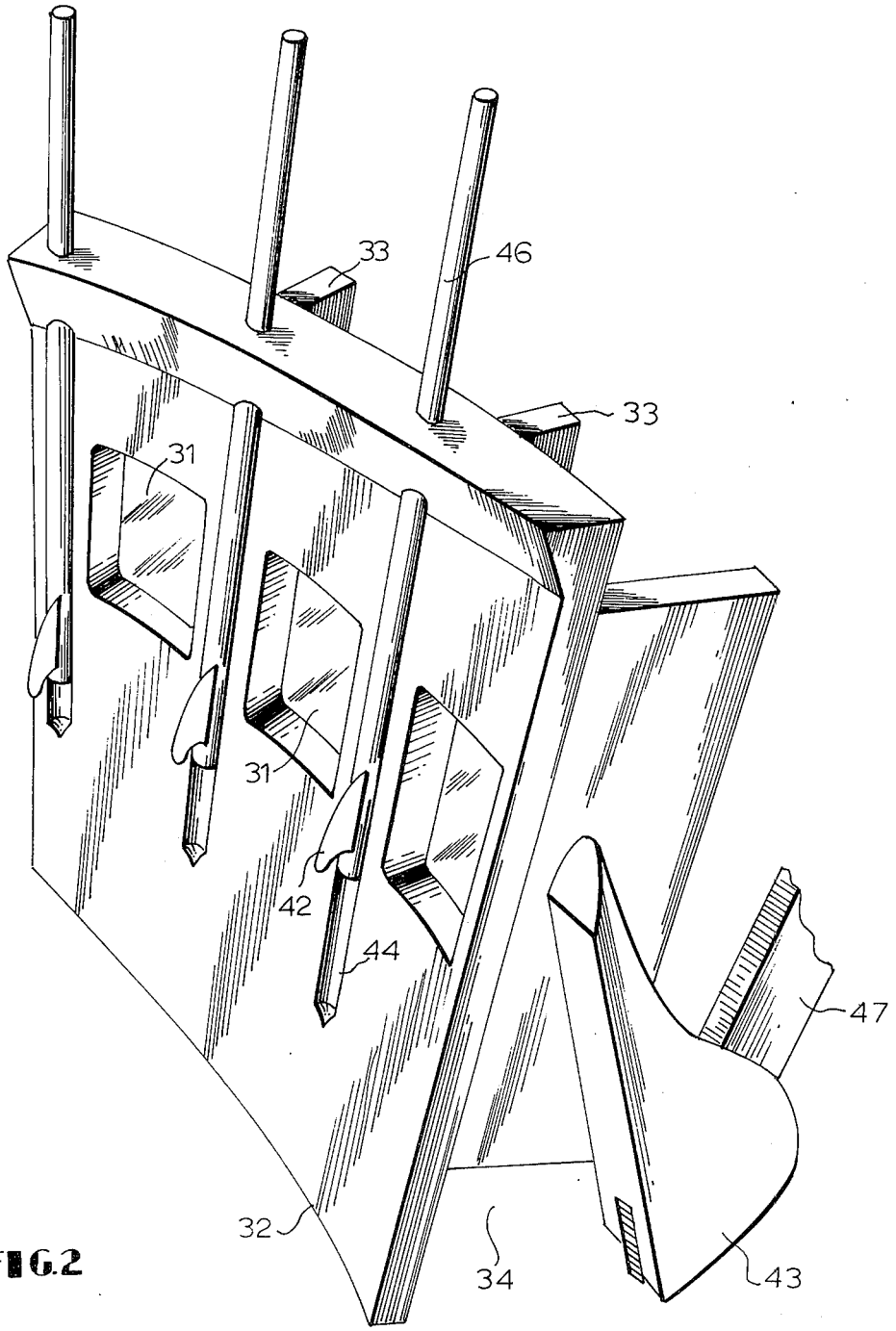
FIG. 2 is a perspective view of a section of FIG. 1 showing a circular comb, a plurality of hooks, and a shoe.
Figure 7:
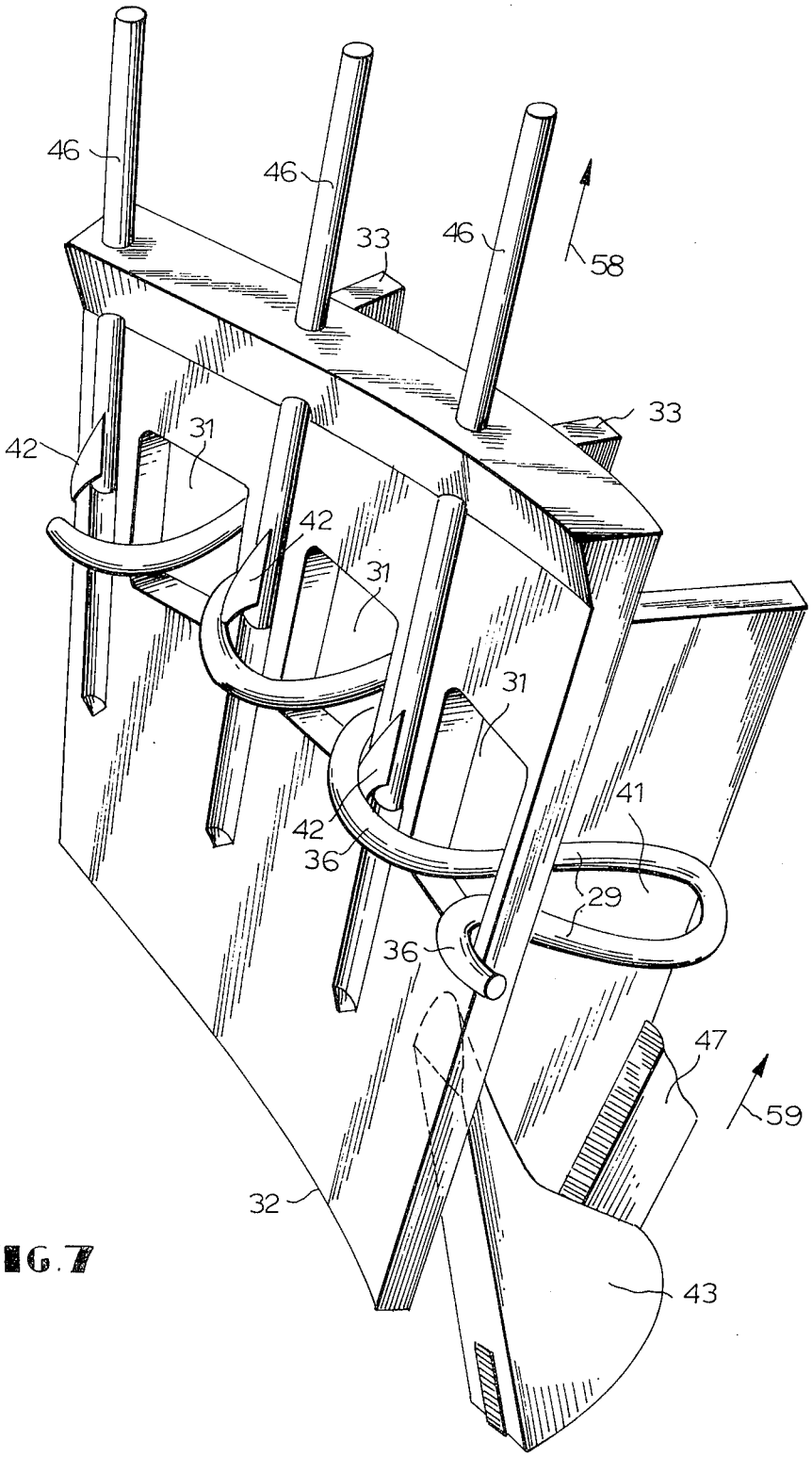

In FIG. 7, the hook 42 and shaft 46 are still rising in the direction of the arrow 58, while the shoe 43 is travelling upwardly in the direction of the arrow 59. Since the top surface of the hook 42 is bevelled or inclined (see FIG. 2), it will not catch the foot 36 of the loop 29.

Figure 8:
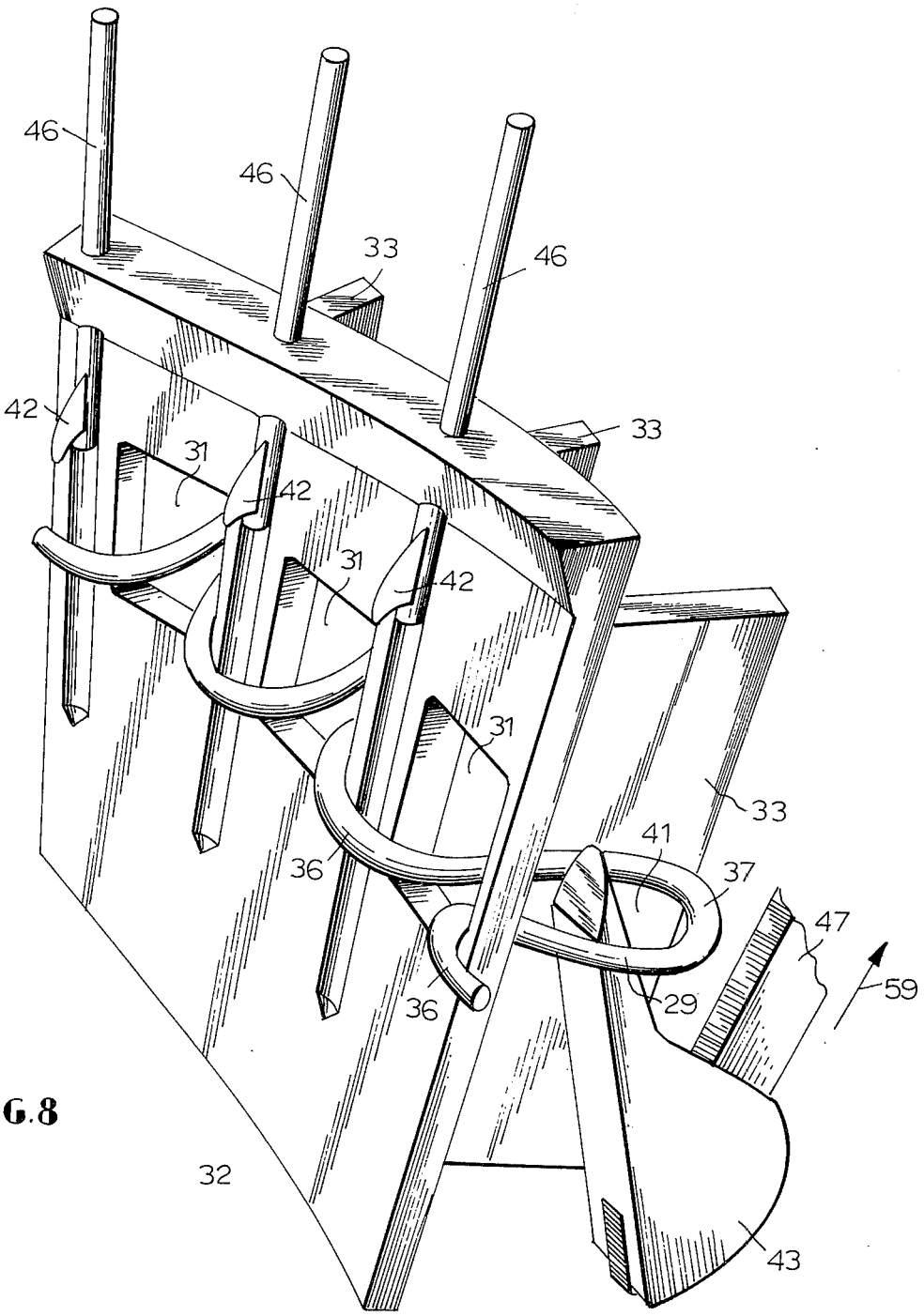

As seen in FIG. 8, the shoe 43 passes through the eye 41 of the loop 29 as the hook 42 and shaft 46 reach their highest position.

Figure 9:
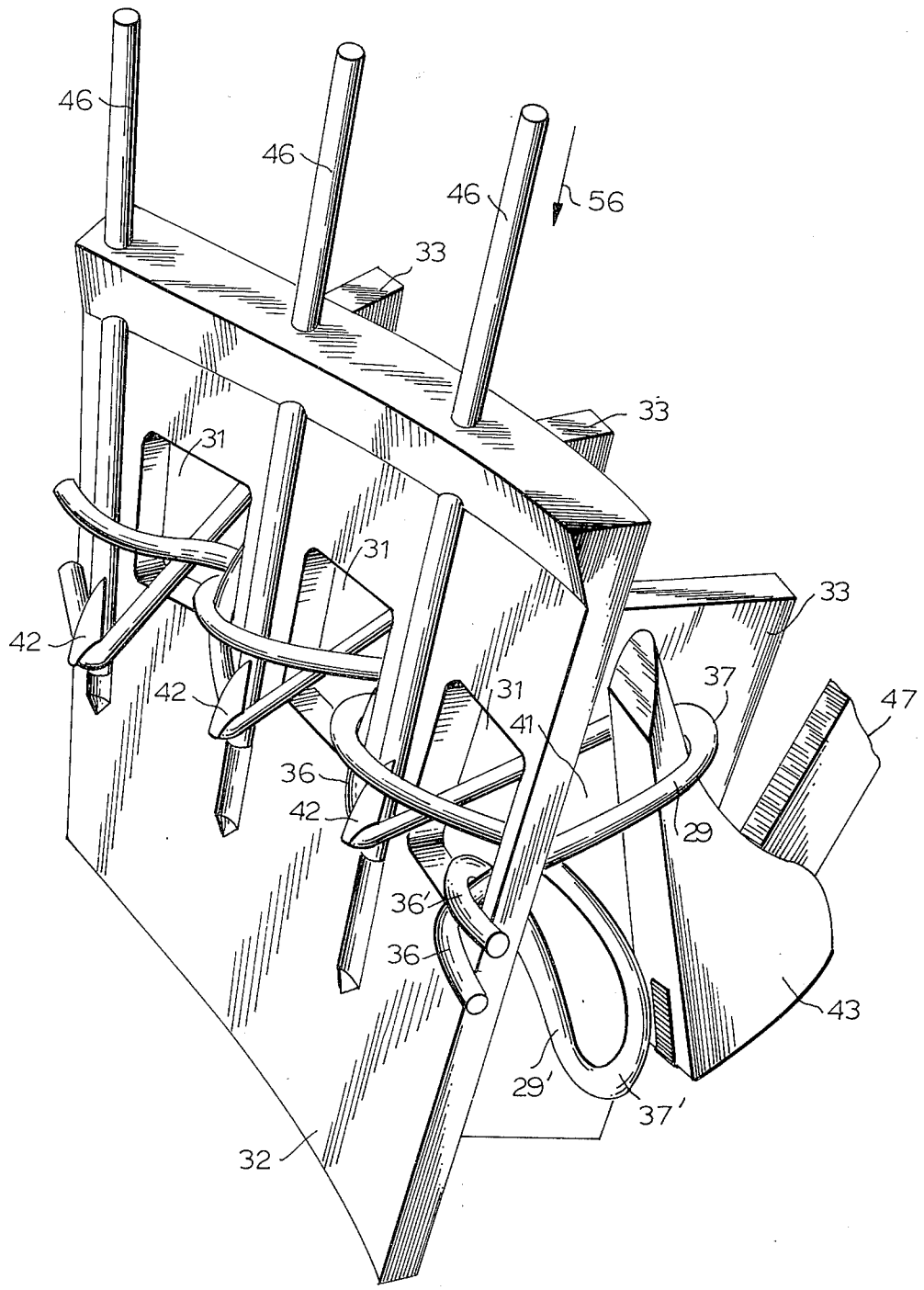

Referring now to FIG. 9, it is seen that the conical spinner 23 has made another revolution and the second loop 29' has been thrust through the aperture 31 and through the eye 41 of the first loop 29. FIG. 9 is essentially similar to FIG. 4, with the exception that in FIG. 9, two loops 29 and 29' are shown, whereas in FIG. 4, only one loop 29 is shown. The loop 29' in FIG. 9 is shown upstream of the shaft 46, just as the loop 29 in FIG. 4 is shown upstream of the shaft 46. However, in FIG. 9, the loop 29 is shown having the foot 36 hooked by the hook 42 which is now travelling in the direction of the arrow 56.

Figure 10:
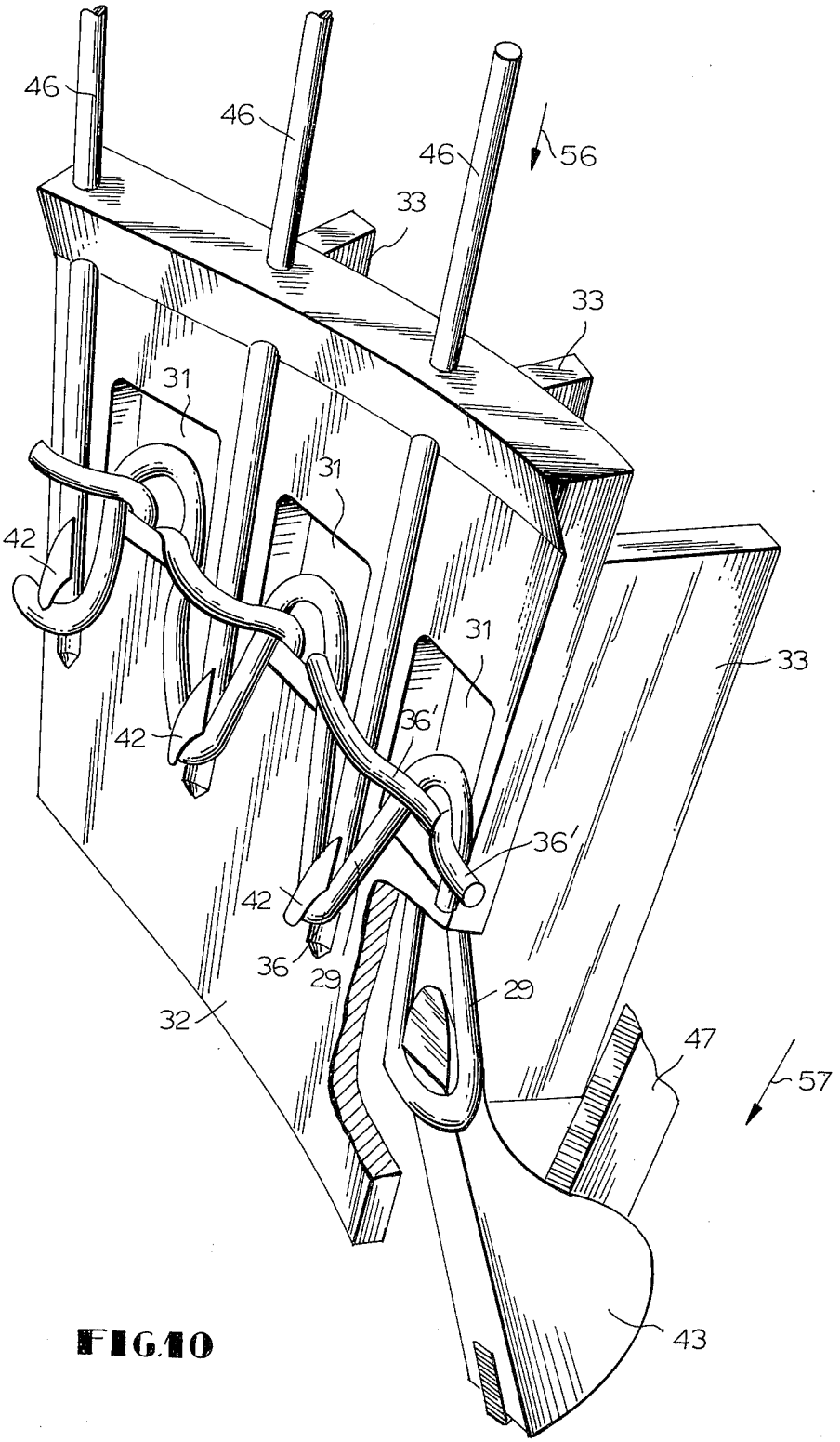

A single stitch is made as the hook 42 and the shoe 43 move from the FIG. 9 position to the FIG. 10 position, which is essentially similar to movement from the FIG. 4 to the FIG. 5 position. In the FIG. 10 position, the shoe 43 is moving in the direction of the arrow 57 and the hook 42 is moving in the direction of the arrow 56. The downward movement of the hook 42 carries the foot 36 of the loop 29 downwardly against the inner surface of the comb 32, pulling the loop 29 through the aperture 31. In the meantime, the shoe 43 retains the new loop 29' against the outer surface of the comb 32, so that it too is not by some circumstance pulled through the aperture 31.

Subsequent to the FIG. 10 condition, the FIG. 6 condition occurs where the shoe 43 now releases the loop 29', so that a second stitch can be formed by a third loop (not shown) as the conical spinner 23 makes another revolution. In this way, stitches are sequentially formed in each of the apertures 31 as the conical spinner 23 rotates, and knitted fabric (not shown) is generated. The knitted fabric emerges from the bottom of apparatus 13 in the form of a sock (not shown).

From the above consideration, it can be seen that a single stitch is formed at each station for each cycle of the spinner 23 relative to that station. Accordingly, if the number of stations is "N", then each revolution or cycle of the spinner 23 forms N stitches. Observing operation of the apparatus 13 over a plurality of cycles shows that completion of the individual stitches indexes from one station to the next when the spinner 23 rotates and that the time period for forming successive stitches at the same station is substantially equal to the time consumed for each cycle. Since the yarn 11 is fed into the apparatus 13 at a much greater rate than it is arranged in stitches, the apparatus readily lends itself to slowing down a strand of yarn travelling at high speed by stitching the yarn, and then eventually bringing yarn to a halt as a knitted fabric, which may be readily stored. In essence the yarn 11 is cyclically configured into a fabric.

Figure 11A:
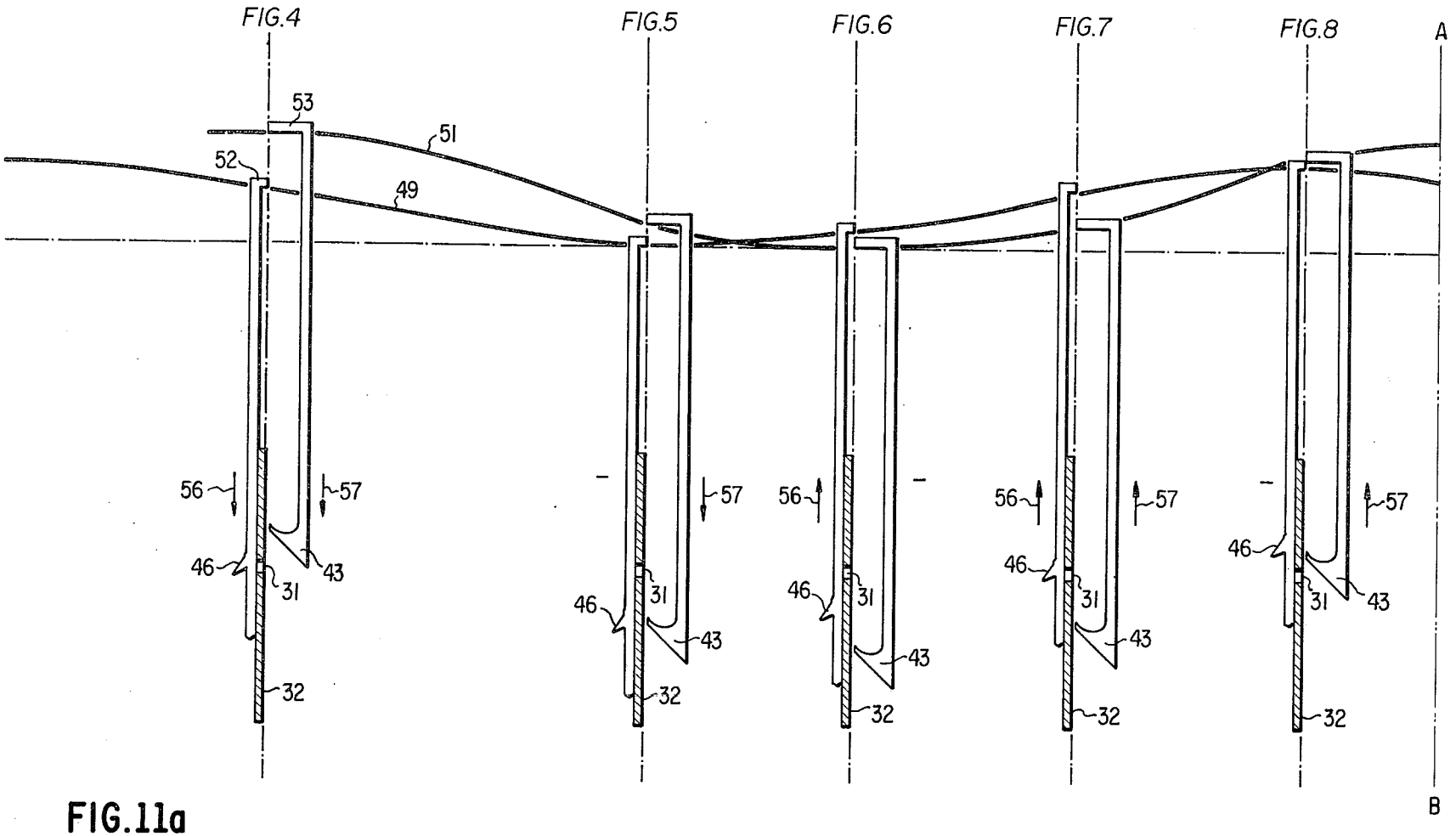
FIGS. 11A and 11B are schematic illustrations showing the profiles of a pair of circular cam tracks, which operate the stitch forming apparatus of FIGS. 4 through 10.
Figure 11B:
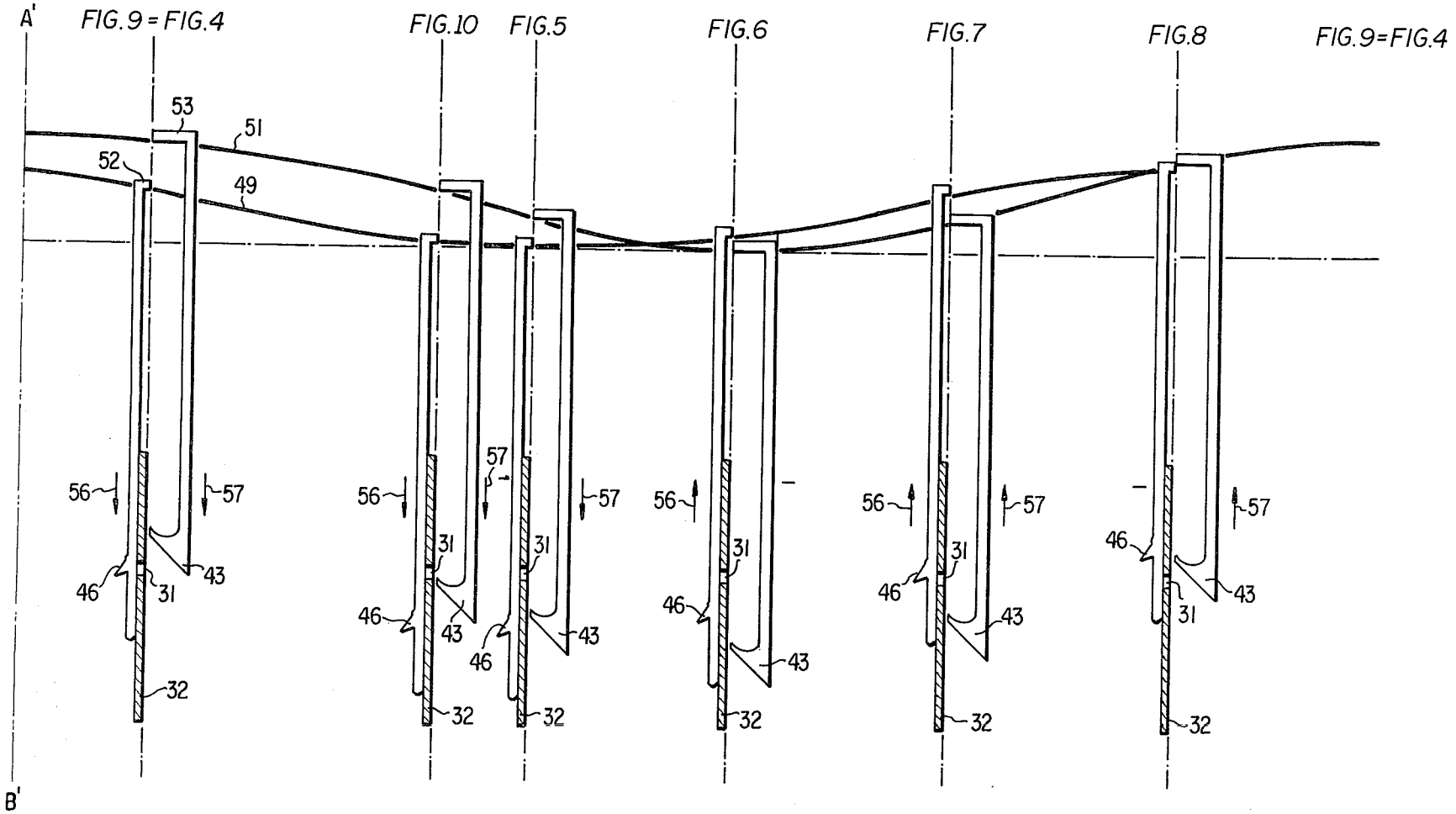

FIGS. 11A and 11B illustrate two cycles of the circular cam 48 secured to the spinner 23, and show positions of the cam tracks 49 and 51, which actuate the hooks 46 and shoes 43 respectively with respect to one aperture 31 of the comb 32. The figure stations identified in FIGS. 11A and 11B relate FIGS. 11A and 11B to FIGS. 4 through 9. FIG. 10 is the same as FIG. 4. The loop 37 of FIGS. 4 through 8 and 37' of FIGS. 9 and 10 are inserted by the discharge tube 19 just after FIG. 8 and FIG. 8'.

By utilizing the afore-described operation, knitting can be formed with two types of movements — a fast movement and a slow movement. In accordance with applicant's invention, these movements have been disassociated so that a continuously fed yarn may be fed or advanced at higher speed. Fast movement occurs as the loops 29 are formed sequentially by fluid pressure, centrifugal force, or a combination of both fluid pressure and centrifugal force. Since the yarn has relatively little mass, formation of the loops can be rapidly accomplished.

The hooks and shoes, on the other hand, operate progressively and may move relatively slowly, because a complete revolution of the spinner 23 may occur before a complete cycle of the shoe and hook movement occurs. By separating the formation of loops from the formation of stitches, the applicant has achieved a major advance in the art of knitting.

From the afore-mentioned operation, it is readily seen that fabric may be formed by the knitting machine 13 immediately upon inserting the yarn 11 into the opening 14 of the knitting apparatus 13. Unlike the knitting apparatus of the prior art, the knitting apparatus 13 does not have to be stopped for an initial threading-up operation.

The afore-described embodiment utilizes a circular knitting machine. However, it should be kept in mind that instead of using a circular knitting machine, a rectilinear knitting machine could be used. With a rectilinear knitting machine, rectilinear comb would be used instead of the aforedescribed circular comb 32, and in place of utilizing the conical spinner 23, a head moving along a path parallel to the rectilinear comb would be used. In a rectilinear knitting machine in which the head does not rotate, the yarn could be propelled solely by a stream of fluid.

Generally, the afore-described apparatus and the invention recited in the appended claims allows high speed manufacture of knitted fabrics at yarn insertion speeds substantially higher than 500 m/min. The afore-described method and apparatus are particularly well suited to manufacturing jersey fabrics cyclically with any type of yarn, be the yarn natural, synthetic, flat, textured, fancy, single, plied, etc.

Because of its great yarn insertion speed, the afore-described method and apparatus may also be used as a rewinding device to store synthetic yarns produced in spinning and extrusion operations. For example, the afore-described method and apparatus could be used to receive yarn issued directly from a spinning device by positioning the induction nozzle 18 (FIG. 1) directly below a spinnerette. In addition, it is also possible, if desired, to use the afore-mentioned method and apparatus to perform the process described in applicant's copending application, Ser. No. 309,963, filed Nov. 28, 1972, entitled "Process and Device for the Storage of Textile Yarns" herein incorporated by reference. In this copending application, freshly extruded textile filaments are knitted by a circular one-ended knitting machine into a continuous, now-rotating tubular sock, which is thereafter stored in a container to await subsequent processing. The aforementioned "one-ended" knitting machine may also be referred to as a "one-cut", "one feed" or "single feed" knitting machine.

The afore-described method and apparatus for knitting yarn is advantageous as opposed to prior knitting methods and apparatus in that the actual knitting device requires only a small floor space, is light in weight, consumes relatively little power, and has great operational flexibility. In addition, the afore-described knitting machine is simple and solid in construction and affords the possibility of automatically effecting threading-up operations.

While the method of and apparatus for practicing the instant invention has been illustrated by way of the foregoing specification and drawings, the specification and drawings are not to be considered as limiting the instant invention, which is properly defined in the following appended claims.

What is claimed is:

1. A method of cyclically configuring yarn into knitted fabric, comprising the steps of:

pushing the yarn by centrifugal force between a series of elements to form the yarn sequentially into a row of loops which protrude beyond the elements in an initial direction during a first cycle, said series of elements being stationary relative to one another in said initial direction of loop protrusion, wherein each loop has an initial orientation;

holding each loop open progressively;

pushing the yarn during a second cycle to form a subsequent row of loops, wherein each loop in the subsequent row is sequentially inserted through a corresponding loop in the first row while the corresponding loop in the first row is held open;

drawing progressively each of the loops of the first row about the inserted loops to complete successive stitches, wherein the formation of each successive stitch requires a time period approximating the period of one cycle; and repeating sequentially each of the afore-cited steps to form the knitted fabric of which the loops have formed at a relatively high rate of speed and each stitch formed at a low rate of speed relative to the speed at which the loops are formed.

2. An apparatus for configuring yarn into knitted fabric with looped-shaped stitches of yarn, comprising:

a series of apertures arrayed in spaced relation to form a row;

dispensing means for pushing the yarn sequentially through the apertures to form a row of loops;

means for cyclically operating said dispensing means;

non-rotating shoe means aligned with each aperture for, upon movement in a first direction, retaining momentarily each loop in an aperture in a first position, and for, upon movement in a second direction, displacing each loop in an open configuration to a second position to receive a subsequently formed loop therethrough;

non-rotating hook means for engaging the yarn positively after each loop receives a subsequently formed loop therethrough;

means disposed adjacent to each aperture for mounting the hook means to retrain the hook means to reciprocal motion; and control means for coordinating the motion of the shoe means relative to the hook means, to cause the shoe means to open the loops progressively, while the hook means tightens the loops progressively and carries the resulting successive stitches away, said control means including means to cycle the shoe means and hook means once during each cycle of the dispensing means.

3. An apparatus according to claim 2, wherein the dispensing means for inserting the yarn to form the loops is a rotor having a longitudinally extending axial bore through which the yarn is inserted initially, and a radially extending bore interconnecting with the axial bore from which the yarn is dispensed as the rotor rotates, and wherein the series of apertures are disposed in a position to register with the radially extending bore to receive the yarn.

4. An apparatus according to claim 3, wherein the radially extending axial bore is slanted with respect to the longitudinally extending axial bore.

5. An apparatus according to claim 2, wherein said control means includes cam means which move the hook means and shoe means with a substantially parallel reciprocating motion.

6. An apparatus according to claim 5, wherein said dispensing means is a rotor and wherein said cam means includes a pair of cam tracks disposed to rotate with the rotor to engage followers on the hook means and shoe means to thereby move the hook and shoe means relative to one another and out of phase with one another.

7. An apparatus according to claim 2, wherein said hook mounting means are disposed between said apertures.

8. An apparatus according to claim 2, further including means for entraining the yarn in an expanding stream of fluid to eject the yarn from the dispensing means.

9. An apparatus for configuring yarn into knitted fabric with looped-shaped stitches of yarn, comprising:

dispensing means for pushing the yarn to dispense the yarn continuously during successive cycles to receiving means;

the receiving means including means which configure the pushed yarn into a sequential series of loops as the yarn is received wherein said receiving means includes no elements which move relative to one another;

means for engaging each loop after the loop is formed;

means for actuating said engaging means to move each loop to a displaced position while holding each loop open to receive therein a subsequent loop from said dispensing means during a subsequent cycle;

means for moving each loop away from said displaced position and away from said engaging means while drawing each loop about said subsequent loop to form a stitch; and means for actuating said moving means to coordinate the operation of said moving means with the actuation of said engaging means, said actuating means including means to cycle said engaging means and said moving means once for each cycle of said dispensing means to form a stitch during each successive cycle of the dispensing means wherein the knitted fabric is formed by rapidly forming loops while relatively slowing forming the loops into stitches.

10. The apparatus of claim 9, wherein the means for dispensing the yarn is a rotating head having a bore through which the yarn is passed and an outlet through which the yarn is ejected, wherein the means for receiving the yarn is a circular magazine disposed about the rotating head and wherein the means for configuring the yarn in a sequential series of loops is a row of equally spaced apertures in the circular magazine aligned to register with the outlet of the bore.

11. The apparatus of claim 10, further including injector nozzle means aligned with said bore to entrain the yarn in an expanding stream of fluid and push the yarn into said apertures.

12. An apparatus for knitting yarn during a series of successive cycles, comprising:

an array of stitching stations having a total number "N";

dispensing means for pushing the yarn to distribute the yarn cyclically within said apparatus, wherein said dispensing means completes one cycle of distribution upon passing N stations;

loop forming means at each station through which the yarn is pushed to form a total of N loops with each cycle of said dispensing means with said loops protruding through the loop forming means in a initial direction, said loop forming means having no parts, which move relative to one another in said initial direction of loop protrusion;

means for opening each loop after each loop is formed to receive a subsequent inserted loop therein upon commencing the next cycle with respect to each loop;

means for closing each loop about the respective subsequently inserted loop during the next cycle;

means for programming operation of said loop opening and loop closing means to form progressively a single stitch at each station by the completion of one cycle of said pushing means with respect to that station to thereby index said stitches progressively from one station to the next as said dispensing means rotates and to form N stitches with each cycle of said dispensing means, so that a fabric is knitted by rapidly forming loops, while relatively slowly forming the loops into stitches.

13. The apparatus of claim 12, wherein said programming means operates said loop opening and loop closing means progressively during each cycle according to a sinusoidal pattern.

14. The apparatus of claim 13, wherein the loop forming means is stationary and wherein an individual loop opening means and an individual loop closing means are disposed at each station and reciprocate with respect to said loop forming means.

15. The apparatus of claim 12, wherein the loop forming means are apertures formed in a wall positioned adjacent said dispensing means.

16. The apparatus of claim 15, wherein said dispensing means and said wall are circular and coaxial.

17. The apparatus of claim 12, further including fluid injection means to entrain the yarn and direct the yarn into the apparatus.

18. A method of configuring yarn into knitted fabric comprising the steps of:

feeding the yarn at a high rate of speed through a dispensing means;

fully forming a row of loops of yarn, by pushing the yarn from the dispensing means during a first cycle through loop forming means, wherein each fully formed loop has an initial orientation;

retaining each of the loops in a first position immediately after each loop is formed by advancing first elements thereover in a first direction;

displacing each of the loops progressively from the first position to a second position, by advancing said first elements in a second direction, while holding each loop open with said first elements during a first portion of the cycle;

fully forming the yarn sequentially into a second row of loops during a subsequent cycle, wherein each loop in the second row is pushed through a corresponding loop in the first row, after the corresponding loop in the first row is displaced progressively;

drawing progressively with second elements during the remaining portion of the subsequent cycle, each loop of the first row around each loop in the second row, while holding each loop in the second row in the first position by again advancing said first elements in said first direction to thereby complete a single stitch upon completion of each successive cycle;

displacing progressively each loop in the second row from the first position to the second position by advancing said first elements in said second direction, while holding each of the loops in the second row open with said first elements; and repeating each of the afore-mentioned steps in sequence to generate a series of stitches and configure a knitted fabric, wherein the loops are formed at a high rate of speed, and each stitch is formed at a low rate of speed relative to the speed at which the loops are formed.

19. A method of cyclically configuring yarn into knitted fabric, comprising the steps of:

pushing the yarn with a stream of fluid to form the yarn sequentially into a row of loops during a first cycle, wherein each loop has an initial orientation;

holding each loop open progressively;

pushing the yarn during a second cycle to form a subsequent row of loops, wherein each loop in the subsequent row is sequentially pushed by said stream of fluid through a corresponding loop in the first row while the corresponding loop in the first row is held open;

drawing progressively each of the loops of the first row about the inserted loops to complete successive stitches, wherein the formation of each successive stitch requires a time period approximately the period of one cycle; and repeating sequentially each of the afore-cited steps to configure a knitted fabric of which the loops have formed at a relatively high rate of speed and each stitch formed at a low rate of speed relative to the speed at which the loops are formed.

20. The method of claim 19, wherein the stream of fluid is air.

21. The method of claim 19, wherein the yarn is pushed additionally by centrifugal force.

* * * * *

UNITED STATES PATENT AND TRADEMARK OFFICE

CERTIFICATE OF CORRECTION

PATENT NO. : 3,955,379

DATED : May 11, 1976

INVENTOR[redacted] : CLAUDE CORBIERE

It is certified that error appears in the above-identified patent and that said Letters Patent are hereby corrected as shown below:

Claim 12, line 8, delete "N", insert -- "N" --

Claim 12, line 10, delete "N", insert -- "N" --

Claim 12, line 28, delete "N", insert -- "N" --

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*